US005929823A

United States Patent [19]

Martek et al.

[11] Patent Number: 5,929,823

[45] Date of Patent: Jul. 27, 1999

[54] MULTIPLE BEAM PLANAR ARRAY WITH PARASITIC ELEMENTS

[75] Inventors: Gary Allen Martek, Kent; Todd Elson, Seattle, both of Wash.

[73] Assignee: Metawave Communications Corporation, Redmond, Wash.

[21] Appl. No.: 08/896,036

[22] Filed: Jul. 17, 1997

[51] Int. Cl.[6] ..... H01Q 21/00

[52] U.S. Cl. ..... 343/817; 343/819; 343/853

[58] Field of Search ..... 343/815, 817, 343/818, 819, 820, 846, 853

[56] References Cited

U.S. PATENT DOCUMENTS

| | | | |
|---|---|---|---|
| 3,742,513 | 6/1973 | Ehrenspeck | 343/817 |
| 4,131,896 | 12/1978 | Miller | 343/815 |
| 4,897,664 | 1/1990 | Killackey et al. | 343/817 |
| 5,012,256 | 4/1991 | Maddocks | 343/815 |
| 5,382,959 | 1/1995 | Pett et al. | 343/700 MS |
| 5,485,167 | 1/1996 | Wong et al. | 343/815 |
| 5,589,843 | 12/1996 | Meredith et al. | 343/820 |

*Primary Examiner*—Don Wong
*Assistant Examiner*—Tan Ho
*Attorney, Agent, or Firm*—Fulbright & Jaworski L.L.P.

[57] ABSTRACT

A multiple beam antenna array utilizing strategically placed parasitic elements to control side lobe levels is disclosed. Two specific arrangements of such parasitic elements are taught. A first preferred arrangement of parasitic elements provides for their placement between a ground plane and a plane of active antenna elements. An alternative preferred arrangement of parasitic elements provides for their placement both between a ground plane and a plane of active antenna elements, as well as in front of the active antenna elements. Both such embodiments provide improved side lobe control over a similar antenna system without parasitic elements. Moreover, the characteristics of the main lobe are improved by both embodiments.

31 Claims, 4 Drawing Sheets

MULTIPLE BEAM PLANAR ARRAY WITH PARASITIC ELEMENTS

TECHNICAL FIELD OF THE INVENTION

This invention relates to multiple beam planar array antennas, and, more particularly, to the use of parasitic elements to provide improved shaping of a composite radiation pattern.

BACKGROUND OF THE INVENTION

It is common to use a single antenna array to provide a radiation pattern, or beam, which is steerable. For example, steerable beams are often produced by a linear planar array of antenna elements each excited by a signal having a predetermined phase differential so as to produce a composite radiation pattern having a predefined shape and direction. In order to steer this composite beam, the phase differential between the antenna elements is adjusted to affect the composite radiation pattern. A multiple beam antenna array may be created through the use of predetermined sets of phase differentials, where each set of phase differential defines a beam of the multiple beam antenna.

There are a number of methods of beam steering using matrix type beam forming networks, such as a Butler matrix, that can be made to adjust parameters, such as, for example, might be directed from a computer algorithm. This is the basis for adaptive arrays.

When a linear planar array is excited uniformly (uniform aperture distribution) to produce a broadsided beam projection, the composite aperture distribution resembles a rectangular shape. When this shape is Fourier transformed in space, the resultant pattern is laden with high level side lobes relative to the main lobe. Moreover, as the beam steering increases, i.e., the beam is directed further away from the broadside, these side lobes grow to higher levels.

These side lobes act to degrade the performance of the antenna system by making it responsive to signals in an undesired direction, potentially interfering with the desired signal. Therefore, in most practical applications these high level side lobes are an undesirable side effect.

Additionally, broadside excitation of a planar array yields maximum aperture projection. Accordingly, when such an antenna is made to come off the normal axis, i.e., steered away from the broadside position which is normal to the ground surface and centered to the surface itself, the projected aperture area decreases causing a scan loss. This scan loss further aggravates the problems associated with the increased side lobes because not only is the aperture area of the steered beam decreased due to the effects of scan loss, but the unwanted side lobes are simultaneously increased due to the effects of beam steering.

One prior art attempt to control these undesired side lobes has been to restrict the horizontal spacing between the various antenna elements making up the planar array to a spacing of less than ½λ between the elements. However, such antenna element placement has had limited success.

Another prior art attempt to control these side lobes has been to utilize non-uniform aperture distribution, such as raised cosine aperture distribution. However, this technique results in beam broadening and lower maximum gain.

Accordingly, a need exists in the art for an antenna system which provides for uniform aperture distribution without producing undesirable high level side lobes. Moreover, a need exists in the art for such a system to produce acceptable side lobe levels when the beam comes away from the broadside.

A further need exists in the art for an antenna system which does not rely on inter-element spacing of less than ½λ to reduce undesired side lobes.

These and other objects and desires are achieved by an antenna design which utilizes parasitic elements placed at predetermined locations among the active elements to provide an improved radiation pattern with reduced side lobes.

SUMMARY OF THE INVENTION

The above and other needs and desires are met by an antenna system utilizing parasitic elements placed in strategic locations such that the antenna array's radiation pattern is improved. The radiation pattern resulting from the use of parasitic elements has the desired characteristic of reducing or even suppressing undesired high level side lobes.

In one embodiment of the present invention, parasitic elements are placed at predetermined locations between a horizontal plane of antenna elements and their associated ground plane of a planar broadside array. These parasitic elements are useful in reducing high level side lobes associated with uniform excitation of the antenna elements. Moreover, these parasitic elements result in a more symmetrical radiation pattern emanating from the array.

An alternative embodiment of the present invention utilizes parasitic elements placed both between a horizontal plane of antenna elements and their associated ground plane as well as outboard of the horizontal plane of antenna elements. These parasitic elements cooperate to not only reduce high level side lobes associated with excitation of the antenna elements, but also operate to produce better symmetry in the resulting radiation pattern.

Accordingly, a technical advantage of the present invention is to use strategically placed parasitic elements in addition to the active elements of an antenna array to produce a composite radiation pattern having reduced, and therefore more desirable, side lobes.

A further technical advantage of the present invention is to utilize parasitic elements to result in improved beam symmetry even when the beam is steered from the broadside direction.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
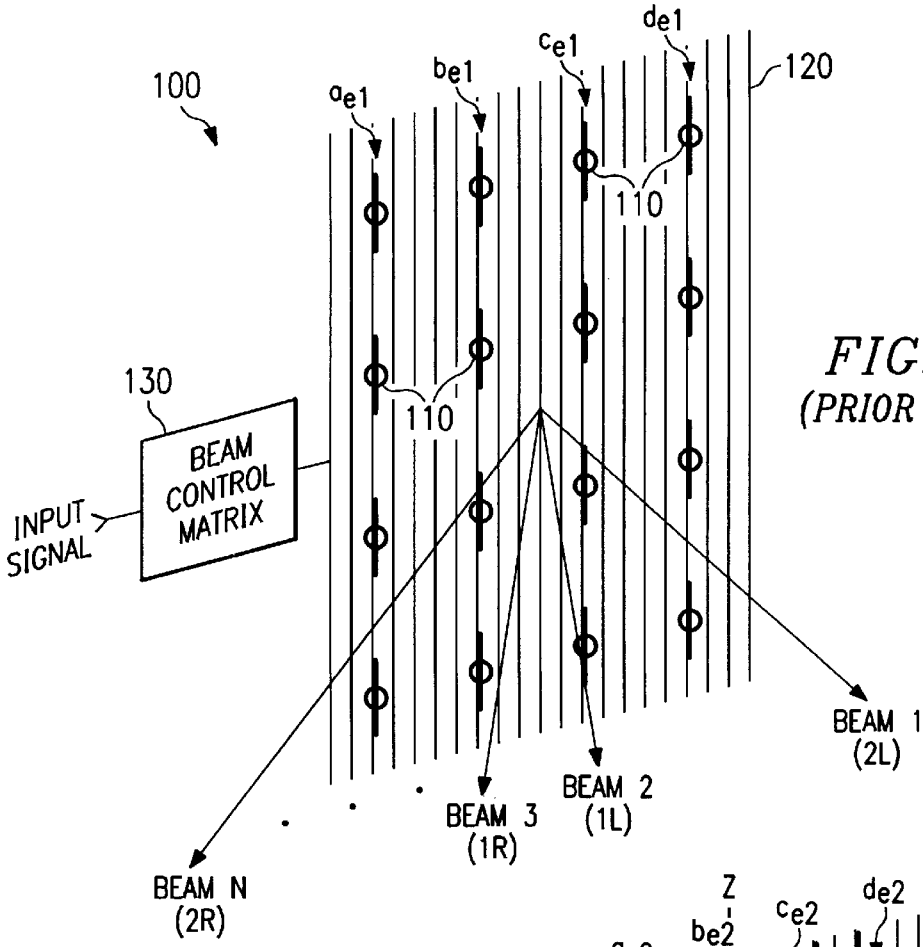
FIG. 1 (PRIOR ART)
FIG. 1 shows a perspective view of a typical prior art planar antenna array.

A typical prior art planar array suitable for producing steerable beams is illustrated in FIG. 1 as antenna array 100. Antenna array 100 is composed of individual antenna elements 110 arranged in a predetermined pattern to form four columns, columns $a_{e1}$ through $d_{e1}$, of four elements each. These antenna elements are disposed a predetermined fraction of a wavelength ($\lambda$) in front of ground plane 120. It shall be appreciated that energy radiated from antenna elements 110 will be reflected from ground plane 120, summing to form a radiation pattern having a wave front propagating in a predetermined direction. This predetermined direction may be adjusted through the use of adaptive techniques such as introducing a phase differential in the signal between each radiator column $a_{e1}$ through $d_{e1}$.

Antenna array 100 has coupled thereto beam control matrix 130. Beam control matrix 130 provides circuitry to accept an input signal and provide it to the various columns of antenna array 100, with the aforementioned adaptive technique, such that beams having wave fronts propagating in different directions may be formed. For example, each of the beams 1 through N as illustrated may be formed by beam control matrix 130 properly applying an input signal to antenna columns $a_{e1}$ through $d_{e1}$. Where four such beams are formed (i.e., N=4), these beams are commonly referred to from right to left as beams 2L, 1L, 1R, and 2R corresponding to beams 1 through N of FIG. 1.

Beam control matrixes, such as a Butler matrix, are well known in the art. These matrixes typically provide for various phase delays to be introduced in the signal provided to various columns of the antenna array such that the radiation patterns of each column sum to result in a composite radiation pattern having a primary lobe propagating in a predetermined direction.

These composite radiation patterns may be azimuthally steered from the broadside. For example, beam 2L (beam 1 of FIG. 1) may be steered 45° from the broadside direction through the introduction of an increasing phase lag ($\Delta$, where $\Delta<0$) between the signals provided to columns $a_{e1}$ through $d_{e1}$. Assuming that the horizontal spacing between each of the columns $a_{e1}$ through $d_{e1}$ is the same, beam 2R may be created by providing column $a_{e1}$ with the input signal in phase, column $b_{e1}$ with the input signal phase retarded $\Delta$, column $c_{e1}$ with the input signal phase retarded 2$\Delta$, and column $d_{e1}$ with the input signal phase retarded 3$\Delta$. Of course the exact value of $\Delta$ depends on the spacing between the columns.

Similarly, beam 1L (beam 2 of FIG. 1) may be 15° from the broadside direction through the introduction of a phase lag between the signals provided to the columns. Here, however, the phase differential need not be as great as with beam 2R above as the deflection from broadside is not as great. For example, beam 1R may be created by providing column $a_{e1}$ with the input signal in phase, column $b_{e1}$ with the input signal phase retarded $\frac{2}{3}\Delta$, column $c_{e1}$ with the input signal phase retarded $\frac{2}{3}\Delta$ ($2*\frac{1}{3}\Delta$), and column $d_{e1}$ with the input signal phase retarded $\Delta$ ($3*\frac{1}{3}\Delta$).

It shall be appreciated that, when a linear planar array is excited uniformly (uniform aperture distribution) to produce a broadsided beam projection, the composite aperture distribution resembles a rectangular shape. However, when this shape is Fourier transformed in space, the resultant pattern is laden with high level side lobes relative to the main lobe. When beam steering is used, i.e., the beam is directed away from the broadside, these side lobes grow to higher levels. For example, beam 2R will have associated therewith larger side lobes than those of beam 1R and, therefore, present a radiation pattern typically less desirable than that of beam 1R.

Figure 4:
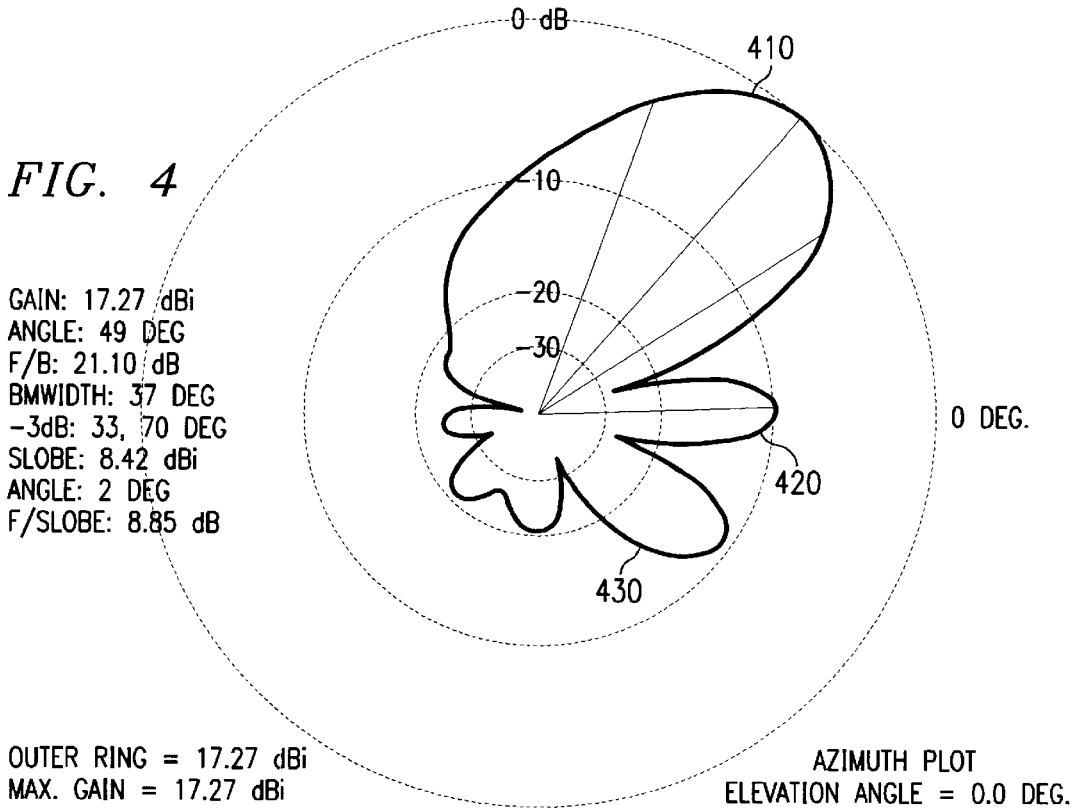
FIG. 4 is an estimated azimuthal far-field radiation pattern using the method of moments with respect to the antenna shown in FIG. 1 for a beam steered away from the broadside direction.

Directing attention to FIG. 4, an estimated azimuth far-field radiation pattern using the method of moments with respect to the antenna array shown in FIG. 1 is illustrated. Here the antenna columns are uniformly excited to produce main lobe 410 substantially 45° from the broadside and, thus, substantially as described above with respect to beam 2R.

It shall be understood that, since a beam steered a significant angle away from the broadside, such as beam 2R, presents a less desirable radiation pattern than that of a beam having a lesser angle, such as beam 1R, discussion of the present invention is directed to a beam having a significant angle to more readily illustrate radiation pattern improvement. However, the radiation patterns of beams deflected more or less from the broadside than those described will be similarly improved according to the present invention.

Referring again to FIG. 4, side lobes 420 and 430 are illustrated as only approximately 9 dB less than main lobe 410. These side lobes act to degrade the performance of the antenna system by making it responsive to signals in an undesired direction, potentially interfering with the desired signal. Specifically, as 0° represents the broadside direction, side lobes 420 and 430 are directed such that communication devices located in front of antenna array 100 may not be excluded from communication when the array is energized to be directed 45° from the broadside.

Moreover, it can be seen from FIG. 4 that, although the 3 dB down points define a beam width of approximately 37°, this beam is somewhat asymmetrical. Specifically, the main lobe exhibits a considerable bulge opposite the aforementioned high level side lobes. This bulge causes the beam not to taper from the 3 dB down points as is typically desirable. Therefore, such a beam presents added opportunity for interference by an undesired communication device.

In a preferred embodiment of the present invention parasitic elements are added to an antenna array to remediate high level side lobes associated with excitation of a planar broadside array. These parasitic elements are placed between the active elements of the antenna array and their associated ground plane.

Figure 2A:
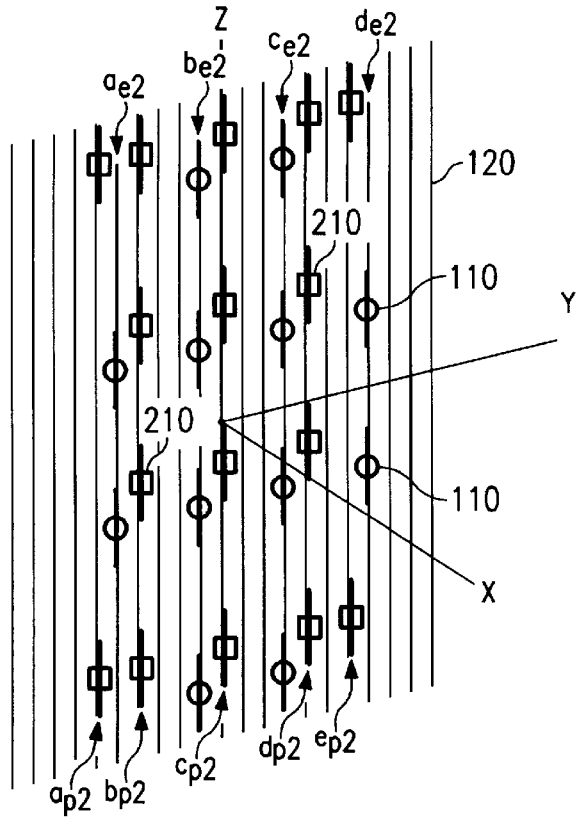
FIG. 2A shows a perspective view of a planar antenna array having parasitic elements placed thereon according to one embodiment of the present invention.

Directing attention to FIG. 2A, a planar array including parasitic elements 210 of the present invention, arranged in columns $a_{p2}$ through $e_{p2}$ located in a plane between the active elements of the antenna array and their associated ground plane, is shown. It shall be appreciated that the active elements of the present invention are arranged substantially as illustrated in FIG. 1. However, the upper and lower most active elements of columns $a_{e2}$ and $d_{e2}$ have been eliminated to further improve the advantages realized by the addition of the parasitic elements. Of course, an antenna array including a different number and/or arrangement of active elements may be used, if desired.

It shall be appreciated that, although a single plane of columns of parasitic elements is shown, the parasitic elements may in fact be placed in any arrangement resulting in improved radiation characteristics according to the present invention. Similarly, although a single plane of columns of active elements are shown, these elements may also take on any arrangement according to the present invention.

Preferably, the parasitic elements of the present invention are 1.3 times the length of the active elements of the planar array. For example, where the active elements are ½λ, the parasitic elements would be 0.65λ according to the preferred embodiment of the present invention. Of course, any length of parasitic element producing a desired composite radiation pattern may be used, if desired.

Referring again to FIG. 2A, it can be seen that in the preferred embodiment the individual parasitic elements are placed vertically within columns $a_{p2}$ through $e_{p2}$ to substantially correspond with the vertical placement of the active elements of radiator columns $a_{e2}$ through $d_{e2}$. Of course, other placements of parasitic elements resulting in the desired control of side lobes may be utilized, if desired.

Figure 2B:
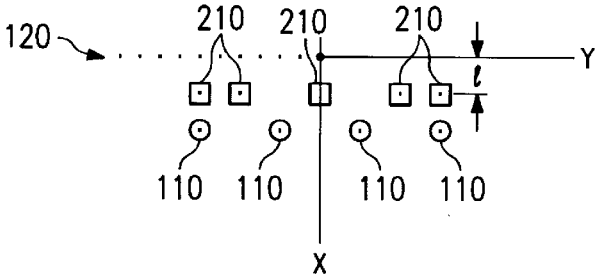
FIG. 2B shows an overhead view of the planar antenna array of FIG. 2A.

The top view of FIG. 2A shown in FIG. 2B more clearly illustrates the placement of the parasitic elements 210, with respect to active elements 110 and ground plane 120. Specifically, the parasitic elements of the present invention are located at a distance "l" off of the ground plane, between the active elements and the ground plane. Experimentation has revealed that when the distance "l" at which the plane comprising the parasitic elements is placed is ⅛λ, desired improvement of side lobe control is achieved.

However, the distance "l" may be any distance such that $0<l<e$, where "e" is the distance from the ground plane to the plane containing the active elements. The optimum case is where $l=e/2$. In contrast, when $l=0$, the parasitic elements are on the ground plane and have no effect and when $l=e$ the parasitic elements are coincident with the active elements and have no effect.

Still referring to FIG. 2B, it can be seen that the columns of parasitic elements are arranged such that the edge columns, columns $a_{p2}$ and $e_{p2}$, are placed directly behind edge radiator columns $a_{e2}$ and $d_{e2}$ respectively when viewed from the broadside direction. Contrariwise, the intermediate columns, columns $b_{p2}$, $c_{p2}$, and $d_{p2}$, are disposed offset from the radiator columns when the array is viewed from the broadside, even though the parasitic elements and radiator columns remain in different planes. This offset arrangement shall be referred to herein as "interleaved."

The above mentioned arrangement of parasitic elements has been found desirable for a number of reasons. Specifically, it undesirable to place parasitic elements directly between the active elements and the ground plane because the BALUN resides there. Additionally, the location of the parasitic elements should not be significantly outboard of the active elements as this causes enlarged side lobes. Also, symmetric positioning of the parasitic elements is desirable in producing a symmetrical radiation pattern. The above mentioned arrangement of parasitic elements incorporates each of these considerations to produce a desirable radiation pattern.

Preferably, where the radiator columns are spaced equally, parasitic element columns $b_{p2}$, $c_{p2}$, and $d_{p2}$ are placed equidistant from their associated radiator column. For example, parasitic element column $b_{p2}$ is placed equidistant from radiator column $a_{e2}$ and $b_{e2}$. Likewise, parasitic element column $c_{p2}$ is placed equidistant from radiator column $b_{e2}$ and $c_{e2}$. Experimentation has revealed that such an arrangement of parasitic and active antenna element columns results in an improved composite radiation pattern.

Figure 5:
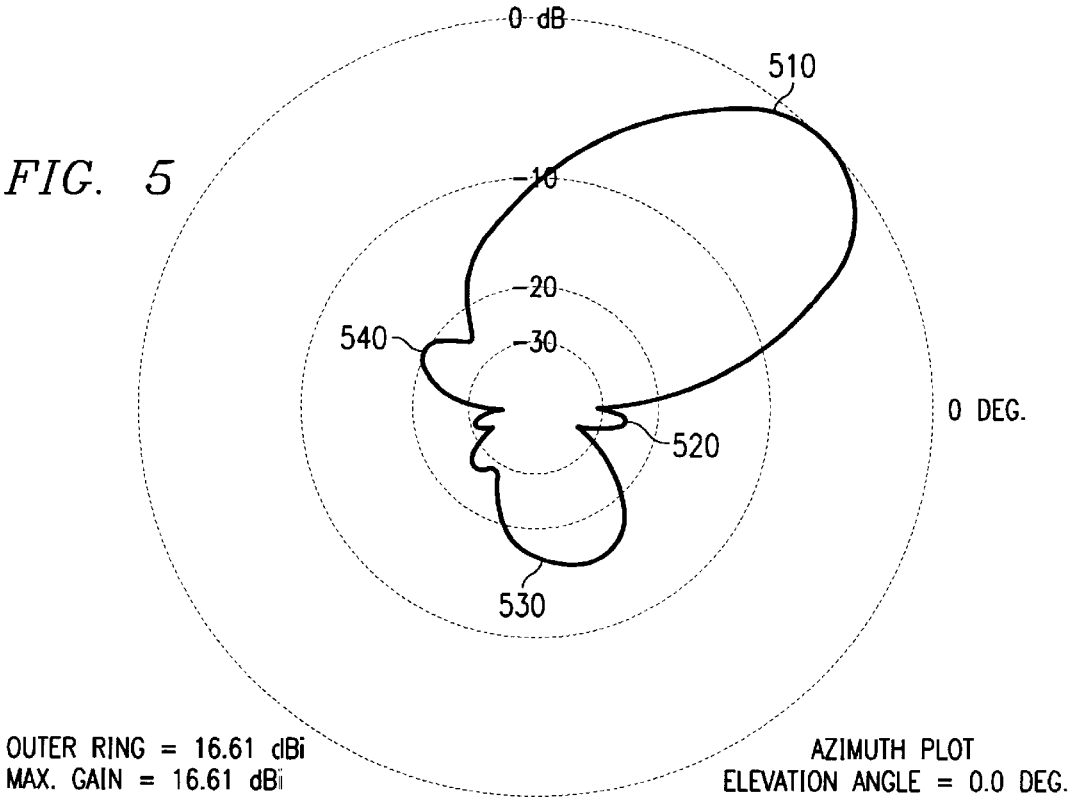
FIG. 5 is an estimated azimuthal far-field radiation pattern using the method of moments with respect to the antenna shown in FIG. 2.

Directing attention to FIG. 5, an estimated elevation far-field radiation pattern using the method of moments with respect to the antenna array shown in FIGS. 2A and 2B is shown. Here, as with the radiation pattern of FIG. 4, the antenna columns are uniformly excited to produce main lobe 510 approximately 45° from the broadside and, thus, substantially as described above with respect to beam 2R. However, it shall be appreciated that side lobe 420 of FIG. 4 has been substantially suppressed through the use of the parasitic elements, resulting in side lobe 520 of FIG. 5. Likewise, side lobe 430 of FIG. 4 has been remediated, resulting in side lobe 530 of FIG. 5.

Introduction of the parasitic elements to the planar array results in the formation of a side lobe opposite those previously existing. This additional side lobe is shown as lobe 540 in FIG. 5. It shall be appreciated that although this lobe is formed/enlarged through the addition of the parasitic elements to the planar array antenna, it is a very low order side lobe and directed away from the front of the array and is thus typically an acceptable tradeoff.

Still referring to FIG. 5, it can be seen that introduction of the parasitic elements has produced a more symmetric main lobe. Such symmetry is typically desirable when, for example, designing a system providing directional coverage through the use of multiple beams.

In an alternative preferred embodiment of the present invention parasitic elements are placed outboard of the active elements. These outboard parasitic elements are in addition to parasitic elements placed between the active elements of the antenna array and their associated ground plane.

Figure 3A:
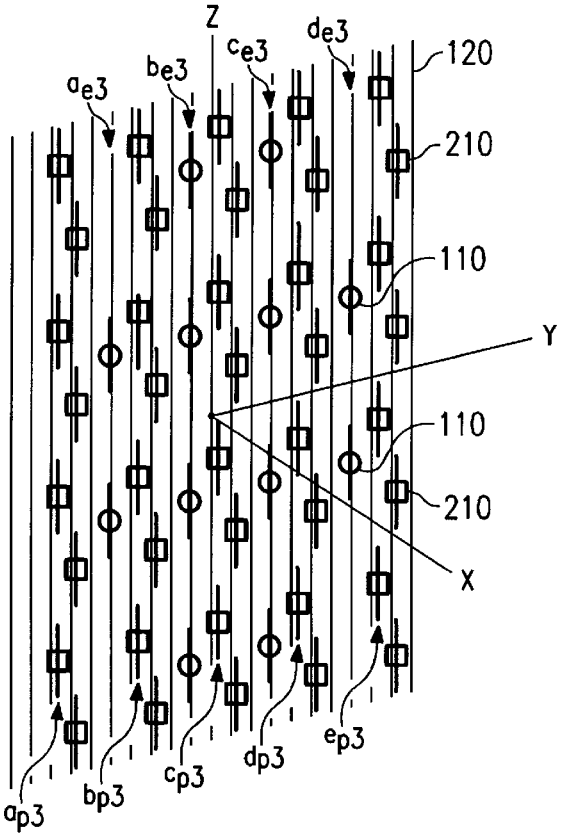
FIG. 3A shows a perspective view of a planar antenna array having parasitic elements placed thereon according to an alternative embodiment of the present invention.

Directing attention to FIG. 3A, a planar array including parasitic elements 210 of this alternative embodiment are shown arranged in columns $a_{p3}$ through $e_{p3}$. It shall be appreciated that columns $a_{p3}$ through $e_{p3}$ each include parasitic elements disposed in a plane between the active elements and the ground plane as well as in a plane in front of the active elements.

As in the above described alternative embodiment, the active elements of this embodiment are arranged substantially as illustrated in FIG. 1. However, the upper and lower most active elements of columns $a_{e3}$ and $d_{e3}$ have been eliminated to further improve the advantages realized by the addition of the parasitic elements. Of course, an antenna array including a different number and/or arrangement of active elements may be used, if desired.

It shall be appreciated that, although only two planes of columns of parasitic elements are shown, the parasitic elements may in fact be placed in any arrangement resulting in improved radiation characteristics according to the present invention. Similarly, although a single plane of columns of active elements are shown, these elements may also take on any arrangement according to the present invention.

Referring again to FIG. 3A, it can be seen that in this alternative embodiment the individual parasitic elements are placed vertically within columns $a_{p3}$ through $e_{p3}$ to substantially correspond with the vertical placement of the active elements of radiator columns $a_{e3}$ through $d_{e3}$. Of course, other placements of parasitic elements resulting in the desired control of side lobes may be utilized, if desired.

Figure 3B:
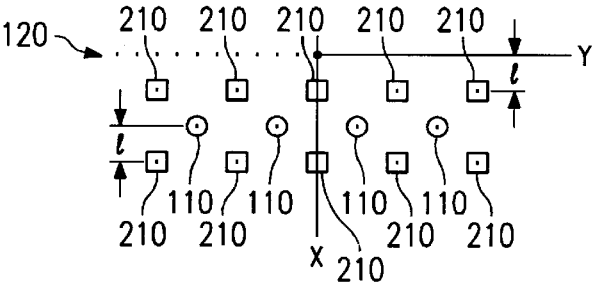
FIG. 3B shows an overhead view of the planar antenna array of FIG. 3A.

The top view of FIG. 3A shown in FIG. 3B more clearly illustrates the placement of the parasitic elements 210, with respect to active elements 110 and ground plane 120. Specifically, a portion of the parasitic elements of the present invention are located at a distance "l" off of the ground plane, between the active elements and the ground plane. The remaining portion of the parasitic elements are located at a distance "l" in front of the active elements.

As with the single plane of parasitic elements described above, experimentation has revealed that placement of the parasitic element planes a distance of ⅛λ from the ground plane and plane of the active elements results in desired improvement of side lobe control. Of course, the distance "l" may be any value chosen as described above, and preferably is one half the distance from the ground plane to the active elements. Moreover, the distance between the ground plane and the corresponding plane of parasitic elements could be different than that between the plane of active elements and the outboard plane of parasitic elements, if desired.

Still referring to FIG. 3B, it can be seen that the columns of parasitic elements are all arranged to be offset, or interleaved, with the radiator columns when the array is viewed from the broadside. It shall be appreciated that, while the same considerations in placing the parasitic elements as in the single plane of parasitic element described above are present in this embodiment, some of the parasitic elements are placed outboard of the active elements. This placement of parasitic elements is desirable in this embodiment as the second plane of parasitic elements operates to offset the enlarging of the side lobes described above.

Preferably, where the radiator columns are spaced equally, parasitic element columns $a_{p3}$ through $e_{p3}$ are placed equidistant from their associated radiator column. For example, parasitic element column $b_{p3}$ is placed equidistant from radiator column $a_{e3}$ and $b_{e3}$. Experimentation has revealed that such an arrangement of parasitic and active antenna element columns results in an improved composite radiation pattern.

Figure 6:
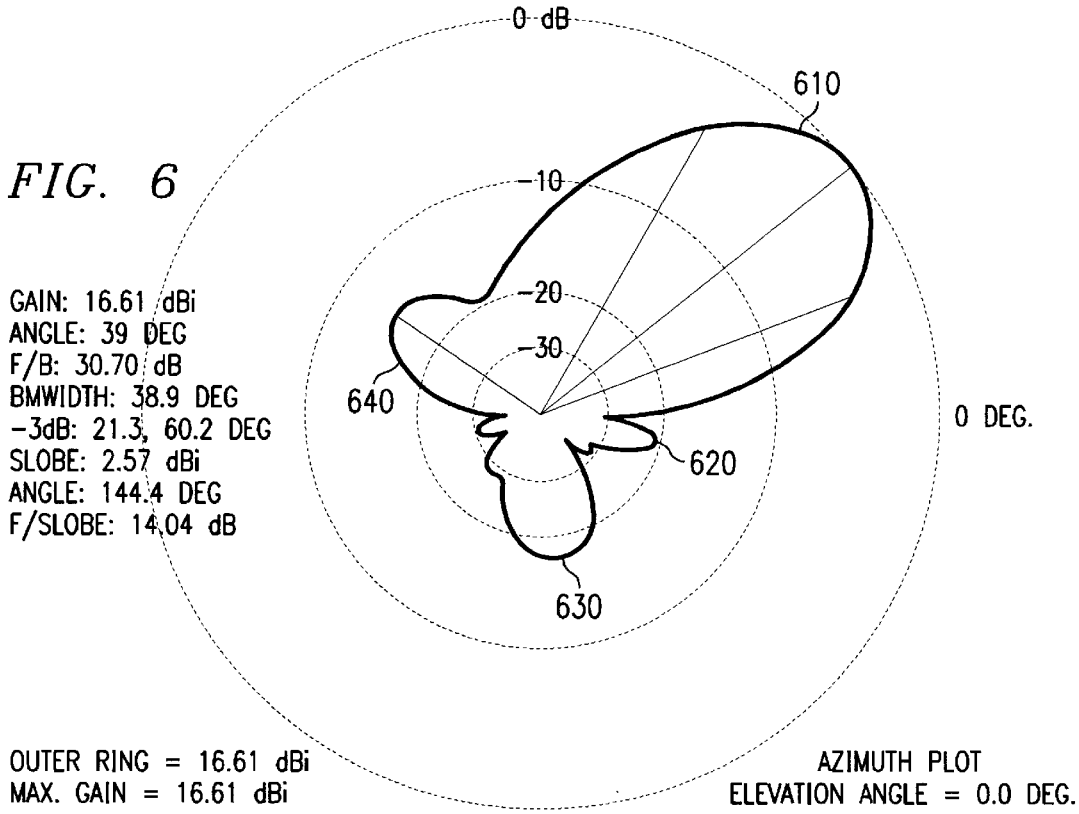
FIG. 6 is an estimated azimuthal far-field radiation pattern using the method of moments with respect to the antenna shown in FIG. 3.

Directing attention to FIG. 6, an estimated azimuth far-field radiation pattern using the method of moments with respect to the antenna array shown in FIGS. 3A and 3B is shown. Here, as with the radiation pattern of FIGS. 4 and 5, the antenna columns are uniformly excited to produce main lobe 610 approximately 45° from the broadside and, thus, directed substantially as described above with respect to beam 2R. However, it will be appreciated that side lobe 420 of FIG. 4 has been substantially reduced through the use of the parasitic elements to result in side lobe 620 of FIG. 6. Likewise, side lobe 430 of FIG. 4 has been remediated, resulting in side lobe 630 of FIG. 6.

Introduction of the above described configuration of parasitic elements to the planar array results in the formation of a side lobe opposite those previously existing in FIG. 4. This additional side lobe is shown as lobe 640 in FIG. 6. It shall be appreciated, that although this lobe is formed/enlarged through the addition of the parasitic elements to the planar array antenna, it is a very low order side lobe and is directed away from the front of the array and is thus typically an acceptable tradeoff.

Still referring to FIG. 6, it can be seen that the introduction of the parasitic elements has produced a more symmetric and better defined main lobe. Comparing main lobe 610 of FIG. 6 to main lobe 410 of FIG. 4, it can be seen that the previously described undesirable bulge opposite the side lobes has been reduced appreciably. This lobe symmetry presents a more slender beam mid-section. As such, the beam has a radiation pattern more closely fitting the azimuthal beam width as defined by the −3 dB points.

Figure 7:
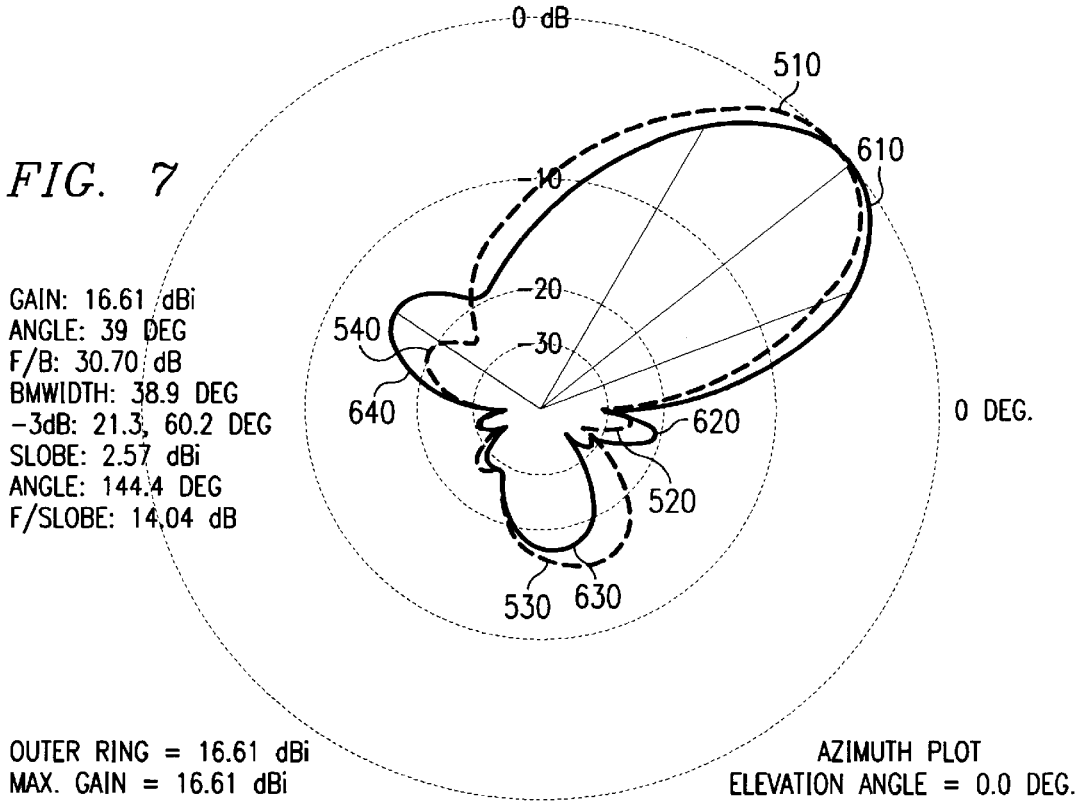
FIG. 7 shows the estimated azimuthal far-field radiation patterns of FIGS. 5 and 6 superimposed.

Directing attention to FIG. 7, the estimated elevation far-field radiation patterns of FIGS. 5 and 6 are shown superimposed. From this illustration, advantages of the two plane arrangement of parasitic elements of FIGS. 3A and 3B over the single plane arrangement of FIGS. 2A and 2B can easily be seen. Specifically, it can be seen that the bulge formerly found in main lobe 410 of FIG. 4 has been reduced in main lobe 610. Additionally, it can be seen that side lobes 630 and 640 are substantially more symmetrical than side lobes 530 and 540. Moreover, the side lobe propagating in a direction most near the front of the antenna array, illustrated here as side lobe 530, has been significantly reduced. This reduces the likelihood that undesired interference will be caused by this side lobe.

Although a planar array adapted to provide four beams having different predetermined angles of propagation has been discussed herein, it shall be appreciated that the present invention is not limited to use in such a system. The present invention is equally useful in controlling side lobes of planar arrays adapted to produce any number of antenna beams.

It shall be appreciated that, although the present invention has been discussed with respect to the forward link (transmission), it is equally adaptable for use in the reverse link (reception) by reversing the signal flow. In such a situation, instead of a structure radiating a signal, the structure would receive a signal.

Furthermore, although the present invention has been described with reference to a planar array having four radiator columns, any configuration of active antenna elements may benefit by the parasitic elements of the present invention. In addition, the ground plane could be curved or folded and the same concepts would apply. Likewise, the number of antenna elements included in any radiator column of the present invention may be varied from that shown. Of course, variation in the number of radiator columns and/or antenna elements will benefit by a corresponding variation in the number of parasitic elements utilized by the present invention. It shall be appreciated that any number of active element configurations may be adapted to utilize the parasitic elements of the present invention through adaptation of the above described placement of parasitic elements by one of ordinary skill in the art.

Additionally, although the use of a ground plane has been disclosed herein, it shall be appreciated that the concepts of the present invention may be realized without a ground plane. For example, a reference surface (or composite of individual surfaces) having no ground connection, may be utilized by the present invention. Likewise, the parasitic elements may be placed as directive and/or reflective parasitic elements without the use of any ground/reference surface, if desired.

Although the present invention and its advantages have been described in detail, it should be understood that various changes, substitutions and alterations can be made herein without departing from the spirit and scope of the invention as defined by the appended claims.

What is claimed is:

1. An antenna system comprising:

a reference surface;

a plurality of radiating structures disposed substantially parallel to and a predetermined first distance from said reference surface, each radiating structure of said plurality of radiating structures being spaced substantially equidistant from and parallel to a next adjacent radiating structure; and a first plurality of passive structures disposed at predetermined positions substantially parallel to and a predetermined second distance from said reference surface, wherein said passive structures provide remediation of the radiation pattern of said antenna system, wherein each passive structure of said plurality of passive structures is disposed parallel to a next adjacent passive structure, wherein said first plurality of passive structures include at least an intermediate passive structure, said intermediate passive structure being disposed substantially equidistant from two next adjacent radiating structures of said plurality of radiating structures.

2. The antenna system of claim 1, wherein said remediation is the modification of at least one high level side lobe.

3. The antenna system of claim 1, wherein said remediation is the modification of an asymmetrical radiation pattern.

4. The antenna system of claim 1, wherein said second distance is less than said first distance.

5. The antenna system of claim 1, wherein said second distance is approximately ½ said predetermined first distance.

6. The antenna system of claim 1, wherein said first plurality of passive structures includes at least an edge passive structure, said edge passive structure being disposed directly between a radiating structure of said plurality of radiating structures and said reference surface.

7. The antenna system of claim 1, further comprising:

a second plurality of passive structures disposed at predetermined positions in a plane substantially parallel to and a predetermined third distance from said reference surface, said second plurality of passive structures cooperating with said first plurality of passive structures to further remediate said radiation pattern.

8. The antenna system of claim 7, wherein said first and second plurality of passive structures are arranged in a substantially identical pattern.

9. The antenna system of claim 7, wherein said third distance is greater than said first distance.

10. The antenna system of claim 9, wherein said third distance is approximately 1½ times said first distance.

11. The antenna system of claim 7, wherein each passive structure of said first and second plurality of passive structures is spaced equidistant from and parallel to a next adjacent passive structure.

12. A method for constructing an antenna array having at least one reduced side lobe when said antenna array is excited utilizing uniform aperture distribution, said antenna array having a plurality of substantially parallel active antenna elements disposed a predetermined distance from a ground surface, said method comprising the steps of:

determining an arrangement of a plurality of parasitic antenna elements wherein energy reradiated by said parasitic antenna elements will be utilized to sum with energy propagating from said active antenna elements to reduce said side lobe;

determining a distance from said ground surface to provide said plurality of parasitic antenna elements wherein at least a portion of energy reflected from said ground surface is directed by said parasitic antenna elements to reduce said side lobe; and equipping said planar antenna array with said plurality of parasitic antenna elements disposed said determined distance in front of said ground surface and arranged in said determined arrangement.

13. The method of claim 12, wherein said determined distance is approximately ½ said predetermined distance from said ground surface said active antenna elements are disposed.

14. The method of claim 12, wherein said arrangement of parasitic antenna elements includes at least two planes of said parasitic antenna elements, wherein said equipping step includes equipping said planar antenna array with a portion of said plurality of parasitic antenna elements disposed said determined distance in front of said ground surface and a portion of said plurality of parasitic antenna elements disposed said determined distance in front of said active antenna elements.

15. The method of claim 12, wherein said determined arrangement provides for interleaved placement of said parasitic antenna elements and said active antenna elements when said planar antenna array is viewed from the broadside.

16. The method of claim 12, wherein said determined arrangement provides for ones of said parasitic antenna elements to be placed directly behind ones of said active antenna elements and other ones of said parasitic antenna elements to be interleaved with ones of said active antenna elements when said planar antenna array is viewed from the broadside.

17. A method for reducing at least one side lobe of a radiation pattern resulting from uniform aperture distribution excitation of a planar antenna array having a plurality of substantially parallel active antenna columns disposed a predetermined distance from a ground surface, said method comprising the steps of:

arranging a set of parasitic antenna columns such that energy reradiated by said parasitic antenna columns will be utilized to sum with energy propagating from said active antenna columns to reduce said at least one side lobe, said arranging step including the step of:

positioning ones of said parasitic columns a determined distance from said ground surface wherein at least a portion of energy reflected from said ground surface is directed by said parasitic antenna columns to reduce said at least one side lobe, wherein said determined distance is less than said predetermined distance and said ones of said parasitic antenna columns are disposed between said ground plane and said active antenna columns; and deploying said planar antenna array with ones of said parasitic antenna columns disposed said determined distance in front of said ground surface and said plurality of parasitic antenna columns arranged in said determined arrangement, wherein said deployed planar antenna array is excited with a uniform aperture distribution.

18. The method of claim 17, wherein said determined distance is approximately ½ said predetermined distance said active antenna columns are disposed from said ground surface.

19. The method of claim 17, wherein said set of parasitic antenna columns includes at least two planes of said parasitic antenna columns, one plane comprising said ones of said parasitic antenna columns and one plane disposed beyond said active antenna columns.

20. The method of claim 19, wherein each of said planes of parasitic antenna columns includes a substantially identical arrangement of parasitic antenna columns.

21. The method of claim 20, wherein said substantially identical arrangement spaces each parasitic antenna column equidistant from and parallel to a next adjacent passive structure.

22. The method of claim 21, wherein said determined arrangement provides for interleaved placement of said parasitic antenna columns and said active antenna columns when said planar antenna array is viewed from the broadside.

23. The method of claim 17, wherein said determined arrangement provides for ones of said parasitic antenna columns to be placed directly behind ones of said active antenna columns and other ones of said parasitic antenna columns to be interleaved with ones of said active antenna columns when said planar antenna array is viewed from the broadside.

24. A system for reducing at least one side lobe of a radiation pattern of a planar antenna array having a plurality of substantially parallel active antenna columns disposed a predetermined distance from a ground surface, said system comprising:

means for positioning a set of parasitic antenna columns such that energy reradiated by said parasitic antenna columns will be utilized to sum with energy propagating from said active antenna columns to reduce said at least one side lobe, said positioning means also for positioning said parasitic columns a determined distance from said ground surface wherein at least a portion of energy reflected from said ground surface is directed by said parasitic antenna columns to reduce said at least one side lobe, wherein said positioning means provides a determined arrangement of said parasitic antenna columns and said active antenna columns including interleaved placement of said parasitic antenna columns and said active antenna columns when said planar antenna array is viewed from the broadside; and means for equipping said planar antenna array with said plurality of parasitic antenna columns disposed said determined distance in front of said ground surface and arranged in said determined arrangement.

25. The system of claim 24, wherein said determined distance is approximately ½ of said predetermined distance said active antenna columns are disposed from said ground surface.

26. The system of claim 24, wherein said set of parasitic antenna columns includes at least two planes of said parasitic antenna columns, said equipping means disposing one plane between said ground plane and said active antenna columns and disposing one plane beyond said active antenna columns.

27. The system of claim 26, wherein each of said planes of parasitic antenna columns includes a substantially identical arrangement of parasitic antenna columns.

28. The system of claim 27, wherein said substantially identical arrangement spaces each parasitic antenna column equidistant from and parallel to a next adjacent passive structure.

29. The system of claim 24, wherein said positioning means provides for ones of said parasitic antenna columns to be placed directly behind ones of said active antenna columns and other ones of said parasitic antenna columns to be interleaved with ones of said active antenna columns when said planar antenna array is viewed from the broadside.

30. A planar antenna system adapted to provide an antenna beam propagating in a predetermined direction having acceptably low side lobe levels when excited through the use of uniform aperture distribution, said antenna system comprising:

a back plane surface;

a plurality of antenna elements disposed in a plane substantially parallel to and a predetermined distance from said back plane surface, each antenna element of said plurality of antenna elements being spaced substantially equidistant from and parallel to a next adjacent antenna element;

a plurality of passive elements, each disposed parallel to a next adjacent passive element to form a plane substantially parallel to and disposed approximately equidistant from said antenna elements and said back plane surface; and said plurality of passive elements including at least two edge passive elements and an intermediate passive element disposed between said edge passive elements, said edge passive elements being disposed directly behind an antenna element of said plurality of antenna elements and said intermediate passive element being disposed to be interleaved with two antenna elements of said plurality of antenna elements when said antenna system is viewed from the broadside.

31. A planar antenna system adapted to provide an antenna beam propagating in a predetermined direction having acceptably low side lobe levels when excited through the use of uniform aperture distribution, said antenna system comprising:

a back plane surface;

a plurality of antenna elements disposed in a plane substantially parallel to and a predetermined distance from said back plane surface, each antenna element of said plurality of antenna elements being spaced substantially equidistant from and parallel to a next adjacent antenna element;

a plurality of passive elements arranged to form at least a first plane and a second plane of passive elements, said first plane of passive elements being substantially parallel to and approximately equidistant from said back plane surface and said antenna elements, and said second plane of passive elements being substantially parallel to and approximately the same distance from said plane of antenna elements as said first plane of passive elements; and said first and second planes of passive elements arranged in a substantially identical pattern of passive elements, wherein said passive elements are disposed to be interleaved with said plurality of antenna elements when said antenna system is viewed from the broadside.

* * * * *